United States Patent [19]

Zahradnik et al.

[11] Patent Number: 4,595,056

[45] Date of Patent: Jun. 17, 1986

[54] METHOD FOR FULLY RETORTING AN IN SITU OIL SHALE RETORT

[75] Inventors: Raymond L. Zahradnik; Carl L. Jacobson, both of Grand Junction, Colo.; Jian-Chyun Shen, Houston, Tex.

[73] Assignee: Occidental Oil Shale, Inc., Grand Junction, Colo.

[21] Appl. No.: 593,438

[22] Filed: Mar. 26, 1984

[51] Int. Cl.[4] ..... E21B 43/243; E21B 47/06

[52] U.S. Cl. ..... 166/251; 166/259; 166/261; 166/64; 166/302

[58] Field of Search ..... 166/259, 261, 302, 256, 166/64; 299/2

[56] References Cited

U.S. PATENT DOCUMENTS

| | | | |
|---|---|---|---|
| Re. 29,553 | 2/1978 | Burton, III et al. | 299/2 |
| 3,240,270 | 3/1966 | Marx | 166/251 |
| 3,357,490 | 12/1967 | Holmes | 166/64 X |
| 3,661,423 | 5/1972 | Garret | 299/2 |
| 3,915,498 | 10/1975 | Burton, III et al. | 299/2 |
| 3,994,343 | 11/1976 | Cha et al. | 166/259 |
| 4,014,575 | 3/1977 | French et al. | 299/2 |
| 4,105,072 | 8/1978 | Cha | 166/261 |
| 4,436,344 | 3/1984 | Forgac et al. | 166/261 X |
| 4,457,374 | 7/1984 | Hoekstra et al. | 166/251 |

*Primary Examiner*—Stephen J. Novosad
*Attorney, Agent, or Firm*—Christie, Parker & Hale

[57] ABSTRACT

A method is provided for operating an in situ oil shale retort in a subterranean formation containing oil shale. The retort contains a fragmented permeable mass of formation particles containing oil shale, within top, bottom and side boundaries of unfragmented formation. A drift is in communication with a lower region of the fragmented mass for withdrawal of liquid products of retorting and an off-gas comprising gaseous products of retorting. A gas-sealing bulkhead is placed across the product withdrawal drift and a water spray is installed in the drift through the bulkhead. An upper region of the fragmented mass is ignited for establishing a combustion zone therein. A retort inlet mixture comprising an oxygen-supplying gas is introduced into the top of the fragmented mass for advancing the combustion zone downwardly through it to thereby establish a retorting zone on the advancing side of the combustion zone for producing the liquid and gaseous products. A retort off-gas comprising such gaseous products is withdrawn from the retort through the product withdrawal drift. The temperature of the off-gas is monitored in the vicinity of the gas-sealing bulkhead. When the off-gas temperature reaches a selected value below the design temperature of the bulkhead, sufficient water is sprayed into the off-gas stream in the drift to maintain the temperature of the off-gas in the vicinity of the bulkhead below its design temperature.

42 Claims, 3 Drawing Figures

METHOD FOR FULLY RETORTING AN IN SITU OIL SHALE RETORT

FIELD OF THE INVENTION

This invention relates to techniques for processing an in situ oil shale retort containing a fragmented permeable mass of formation particles containing oil shale in a retort site within a subterranean formation. More particularly this invention relates to techniques for controlling certain properties of off-gas generated by the retorting process to increase the amount of oil shale that can safely be retorted.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423, 4,043,597, 4,043,598, and 4,192,554 which are incorporated herein by this reference.

The above-mentioned patents describe in situ recovery of liquid and gaseous hydrocarbon materials from a subterranean formation containing oil shale. For example, it is described that such formation is explosively expanded to form a stationary fragmented permeable mass of formation particles, i.e., a rubble bed containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone or front in the retort and introducing an oxygen-supplying retort inlet mixture into the retort to advance the combustion zone downwardly through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced downwardly through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, hydrocarbon aerosols, carbon dioxide from carbonate decomposition, and any gaseous retort inlet mixture that does not take part in the combustion process.

The retort off-gas can be withdrawn from the bottom of the retort through a product withdrawal drift that is in fluid communication with the fragmented mass in the retort. Such a drift, for example, can extend below the bottom of the retort and be in communication with the fragmented mass through one or more vertical raises or drawports. Alternatively, such a drift can extend laterally from the side of the retort at its bottom.

The off-gas produced during retorting can contain carbon monoxide and sulfur compounds such as hydrogen sulfide, both of which are toxic. It is therefore desirable to seal the withdrawal drift so that workers in adjacent underground workings are isolated from the off-gas produced in the fragmented mass during retorting operations. One such gas seal is disclosed in U.S. Pat. No. 4,294,563, which is incorporated herein by this reference.

During the earlier stages of the retorting operation, the retort off-gas is relatively cool, for example less than about 160° F., since it flows through a bed of oil shale particles below the retorting zone that has not yet been heated. As retorting progresses and the combustion zone approaches the bottom of the retort, the off-gas temperature rises.

The oil yield efficiency for an in situ oil shale retort is a function of both the sweep efficiency of the retorting zone, i.e., the percentage of the fragmented mass through which the retorting zone has passed at the conclusion of the retorting process, and the retorting efficiency in that portion of the fragmented mass that was swept by the retorting zone. The retorting efficiency is largely dependent on the oil shale grade and particle size distribution of the fragmented mass. Sweep efficiency, on the other hand, is dependent on the permeability distribution in the fragmented mass and the design of the retort.

When the permeability distribution in the rubble is uneven, those portions of the combustion and retorting fronts that travel through regions of higher permeability can reach the bottom of the retort before portions that travel through regions of lower permeability. When this occurs, the temperature of the off-gas can start to increase while a large fraction of the rubble remains unretorted. In a large commercial-sized retort with a plurality of spaced apart drawports, even when the permeability in the rubble bed is uniform, the combustion and retorting fronts can be distorted. For example, as the combustion and retorting fronts approach the bottom of such a commercial-sized retort, those portions of the combustion and retorting fronts in the regions of the drawports can advance more rapidly than other portions. This effect plus the usual temperature gradient in the retorting zone, can result in a significant rise in the off-gas temperature before the entire fragmented mass is swept by the retorting zone. Thus, in either case, i.e., when the permeability of the fragmented mass is uneven or when a commercial-sized retort with a plurality of drawports is used, the temperature rise of the off-gas can begin before the entire fragmented mass has been swept.

The gas seal provided in the withdrawal drift can be a steel bulkhead which is cemented or grouted around its perimeter into a slot in the drift walls. As the temperature of the off-gas rises it causes increased thermal expansion and buckling of the steel bulkhead which in turn can result in damage to the grout seal and to the drift wall itself. This can result in loss of the integrity of the gas seal and failure of the bulkhead.

It has been found that the retort off-gas temperature can increase to above the maximum temperature for bulkhead safety well before the combustion and retorting fronts passing downwardly through the retort have swept the entire fragmented mass. Since retorting must be stopped for reasons of safety when the off-gas temperature in the withdrawal drift in the region of the bulkhead increases above the bulkhead safety temperature, the unswept portion of the fragmented mass in the retort is not retorted. This results in reduced product yields.

Additionally, when one portion of the combustion front reaches the bottom of the retort before other portions, combustion no longer occurs in that portion of the fragmented mass at the retort's bottom through which the advanced portion of the combustion front has passed. This leaves a pathway through the entire fragmented mass from its top to its bottom through which a portion of the retort inlet mixture can pass without the oxygen contained therein being consumed. This is called "oxygen breakthrough" and can result in the oxygen concentration in the off-gas increasing to unsafe levels before the entire fragmented mass is swept by the retorting zone. When this occurs retorting must be stopped and product yields are less than desired.

It is therefore desired to provide a retorting process that promotes lower off-gas temperatures in the vicinity of the gas sealing bulkhead and eliminates problems associated with oxygen breakthrough.

SUMMARY OF THE INVENTION

This invention relates to a method for operating an in situ oil shale retort in a subterranean formation containing oil shale. The retort contains a fragmented permeable mass of formation particles containing oil shale within top, bottom, and side boundaries of unfragmented formation. A drift is in communication with the lower region of the fragmented mass for withdrawal of liquid products of retorting and an off-gas comprising gaseous products of retorting.

A retort inlet mixture is introduced into an upper region of the fragmented mass in the retort for advancing a retorting zone downwardly through the retort for producing liquid and gaseous products of retorting. An off-gas comprising gaseous products of retorting is withdrawn through the product withdrawal drift. The temperature of the off-gas in the product withdrawal drift is monitored. When the temperature of the off-gas exceeds a first selected temperature, a sufficient amount of water is sprayed into the off-gas stream in the withdrawal drift to thereby maintain the temperature of the off-gas at no more than a second selected temperature.

In one embodiment of the present invention, during a first time period, a retort inlet mixture comprising an oxygen supplying gas such as air and steam is introduced into the retort, and during a second time period, later than the first time period, a retort inlet mixture comprising air in the substantial absence of steam is introduced into the retort. The second time period preferably commences after the waterspraying operation is started.

In yet another embodiment of the present invention a first retort inlet mixture comprising an oxygen supplying gas is introduced into an upper region of the fragmented mass for advancing a combustion zone downwardly through a major upper portion of the fragmented mass and for advancing a retorting zone downwardly through the fragmented mass on the advancing side of the combustion zone. Thereafter, a second retort inlet mixture substantially free of oxygen is introduced into the upper region of the fragmented mass for advancing the retorting zone, in the absence of the combustion zone, downwardly through a minor lower portion of the fragmented mass.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

Figure 1:
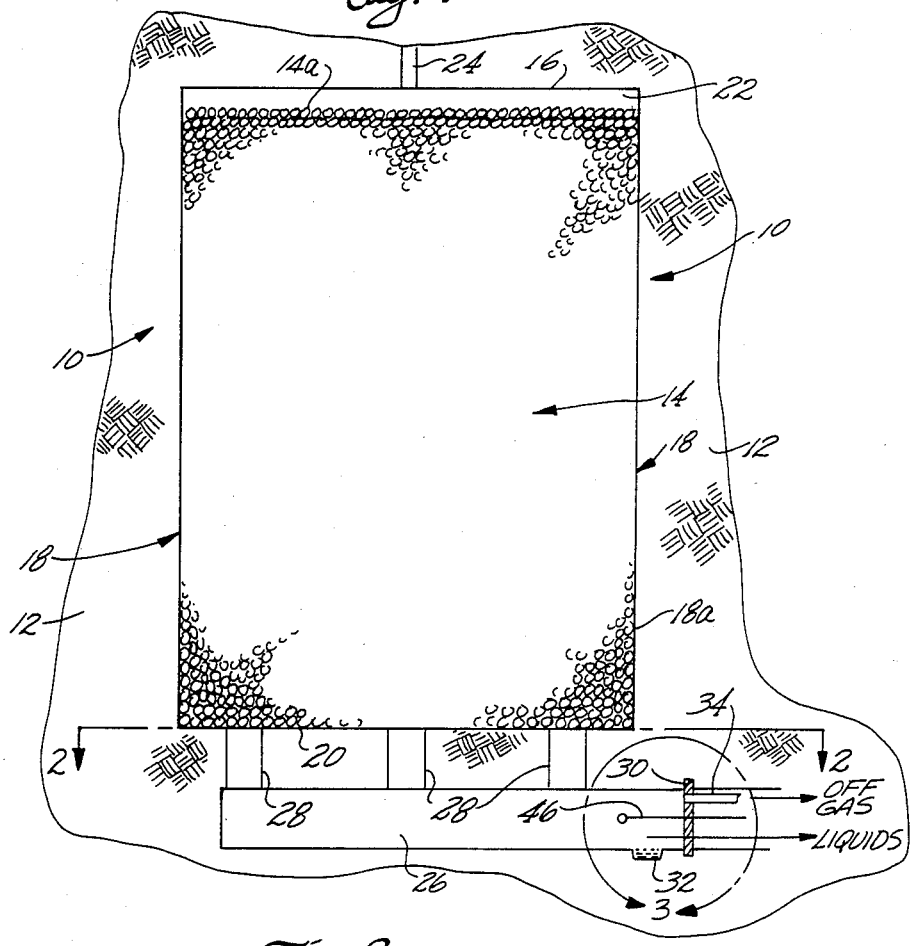
FIG. 1 is a semi-schematic, vertical cross sectional view of one embodiment of an in situ oil shale retort which can be operated in accordance with practice of the methods of this invention.

Referring to FIG. 1 there is shown a semi-schematic vertical cross sectional view of an in situ oil shale retort 10 in a subterranean formation 12 containing oil shale. As is described below in greater detail, the retort 10 can be operated in accordance with practice of principles of the retorting methods of this invention.

The retort 10 contains a fragmented permeable mass of formation particles 14 containing oil shale within a top boundary 16, four generally vertically extending side boundaries 18 and a bottom boundary 20 of unfragmented oil shale formation. A void space or plenum 22 extends between the top surface **14*a* of the fragmented mass and the top boundary 16** of the retort. Retorts without such a void space can also be used, if desired.

The cavity which is defined by the retort boundaries and the fragmented mass or rubble contained therein, can be formed by a variety of techniques, details of which are not important for understanding the retorting methods of this invention. Techniques for forming such a cavity and the associated fragmented mass can be found, for example, in the aforementioned U.S. Pat. Nos. 3,661,423, 4,043,597, 4,043,598, and 4,192,554.

Although the illustrated retort 10 is generally rectangular in horizontal cross section, the retorting methods provided in accordance with practice of this invention are useful for retorts having other configurations as well.

Access to the top of the retort for ignition and for supplying a retort inlet mixture into the retort is provided by means of one or more conduits 24 that extend through the top boundary 16 of the retort. Alternatively or in addition, if desired, access to the top of the retort can be provided by means of a tunnel or drift (not shown) that can extend horizontally away from the retort at its top.

A drift 26 is at the bottom of the retort for removal of liquids, such as liquid products of retorting and water, which may be present from a variety of sources. Off-gas from the retorting process is also removed from the retort through the drift 26. As is mentioned above, such off-gas contains combustion gas, including carbon dioxide generated in the combustion zone, gaseous products produced in the retorting zone, hydrocarbon aerosols, carbon dioxide from carbonate decomposition, and any portion of the retort inlet mixture that does not take part in the combustion process. The off-gas produced during retorting can also contain carbon monoxide and sulfur compounds such as hydrogen sulfide.

In the illustrated embodiment, the drift 26 extends below the elevation of the bottom boundary of the retort. The liquids and off-gas produced during retorting enter the drift through one or more vertical raises or drawports 28 that extend upwardly from the top of the drift through the retort bottom boundary 20.

Figure 2:
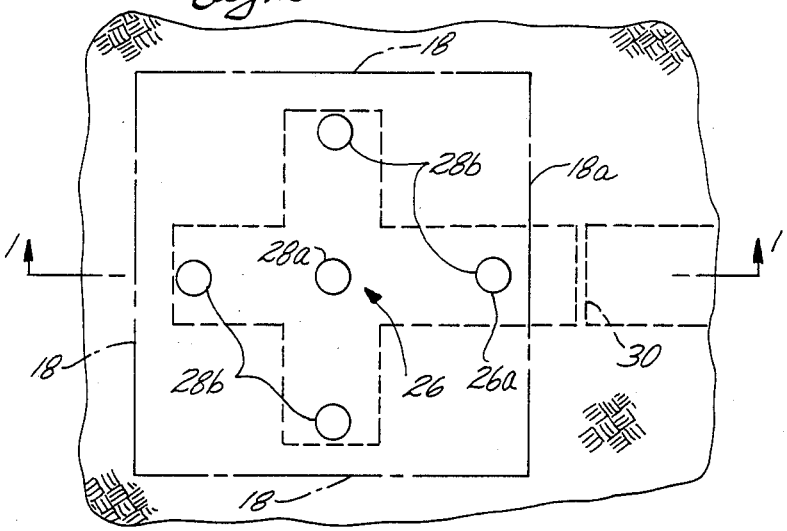
FIG. 2 is a semi-schematic, horizontal cross sectional view on line 2—2 of FIG. 1.

Referring particularly to FIG. 2, in one exemplary embodiment of practice of this invention, the portion of the withdrawal drift 26 below the retort has a cruciform shape. The leg **26*a* of the cross extends beneath the side boundary 18*a* and away from the retort. The drawports 28 are in a five-spot pattern with the drawport 28*a* being at about the horizontal center of the retort, i.e., the drawport 28*a* is at about the center of the cross. Each of the four remaining drawports 28*b* is about equally spaced from the drawport 28*a*** and is in communication with a different one of the legs of the cross.

As is described below in greater detail, the liquid and gaseous products of retorting enter the drift 26 through the drawports 28 and pass from the retort for further processing through the withdrawal drift leg **26*a***.

In order to protect personnel in adjacent mine workings from toxic off-gas and heat produced during retorting operations, a gas seal 30 is provided across the drift 26 in the portion **26*a* of the drift that extends away from the retort. In one exemplary embodiment the gas seal 30** comprises a steel bulkhead that is cemented or grouted into grooves in the walls, floor, and roof of the formation surrounding the drift. One such gas seal is described in U.S. Pat. No. 4,294,563 which is incorporated hereinabove by reference.

Remaining components that comprise the retort 10 are described below in association with a discussion of techniques provided in accordance with practice of this invention for operating the retort.

RETORT OPERATION

Figure 3:
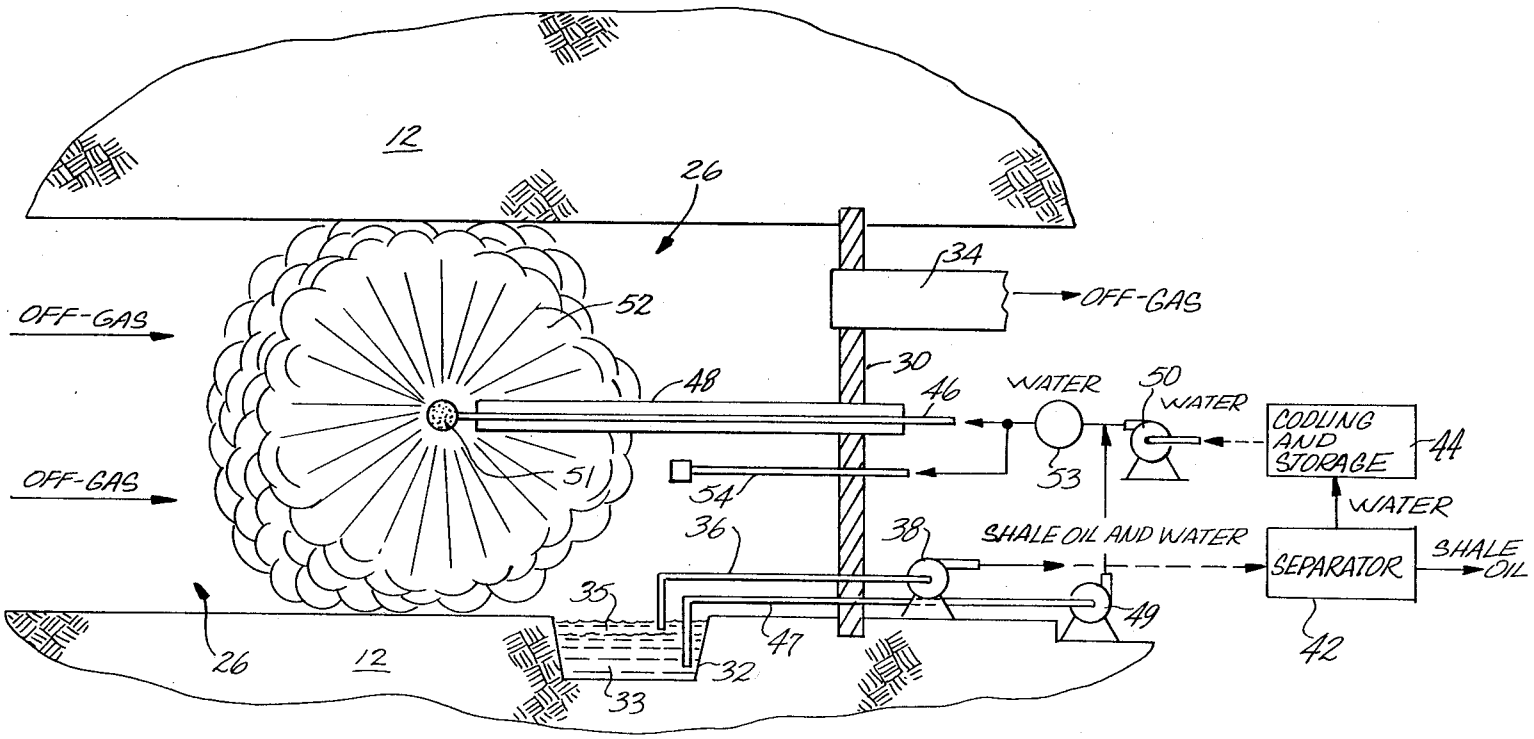
FIG. 3 is a schematic, enlarged, fragmentary view taken inside circle 3 of FIG. 1, illustrating means for cooling off-gas from the retort.

Referring to FIG. 3 in addition to FIG. 1, the retort 10 is ignited, i.e., a combustion zone is formed across the top surface **14*a* of the fragmented mass 14 by introducing hot ignition gas through the conduit 24 into the void space 22 between the fragmented mass surface and the retort top boundary. The void space 22 acts as a plenum for distributing the ignition gas across the surface 14*a* of the fragmented mass. The ignition gas passes downwardly from the plenum 22, through the fragmented mass, and is withdrawn from the retort through the drift 26**.

The hot ignition gas is preferably an exhaust gas supplied by combining fuel such as shale oil, for example, and an oxygen supplying gas such as air, to a burner and igniting the mixture. Burners such as those described in U.S. Pat. Nos. 3,952,801 and 3,990,835 can be used if desired. U.S. Pat. Nos. 3,952,801 and 3,990,835 are incorporated herein by this reference.

Alternatively, when the hot ignition gas is introduced through a drift (not shown) that extends through a side boundary of the retort at its top, burners such as those called "hot inert gas generators" sold by John Zinc Company of Tulsa, Okla., have been found to be useful.

Preferably, in accordance with practice of principles of this invention, before the retort is ignited, both the maximum acceptable concentration of oxygen in off-gas and the design temperature of the bulkhead 30 are determined.

The "design temperature" of the bulkhead as used herein, means the maximum off-gas temperature that can safely be withstood by the bulkhead without the bulkhead losing its gas-sealing integrity. The design temperature can vary, of course, depending on the configuration of the bulkhead and the make-up of the oil shale formation surrounding the drift. For example, the design temperature of the bulkhead may be limited by the temperature at which the oil shale forming the drift walls loses integrity, e.g., about 750° F. or so. For purposes of exposition herein, the design temperature of the bulkhead is considered to be 250° F.

The determination of the maximum acceptable concentration of oxygen in the retort off-gas can be made for instance, based on guidelines promulgated by the government agency responsible for in situ oil shale retorting operations. (U.S. Department of Labor—Mine Safety and Health Administration).

The maximum acceptable concentration of oxygen in off-gas from the retort is less than the lower explosive limit. This limit for oxygen concentration depends on the composition of the off-gas which can contain various concentrations of carbon monoxide, hydrogen, methane, and other combustible hydrocarbons and the like. The maximum acceptable concentration of oxygen in the off-gas may be appreciably below the lower explosive limit to provide a safety margin against developing a hazardous condition. For example, during retorting operations it is preferred that no oxygen be present in the off-gas. This is because when oxygen is in the off-gas and the off-gas is sufficiently hot, the off-gas can burn in the withdrawal drift. Such burning increases the heat load on the system, can tend to raise the off-gas temperatures above the design temperature of the bulkhead, and reduces the yield of hydrocarbon products from the retorting process.

During retorting, the temperature of the off-gas in the vicinity of the bulkhead is monitored by using thermocouples or other temperature-monitoring means. Additionally, the oxygen concentration in the off-gas is monitored by standard oxygen-monitoring equipment.

Once retort ignition is complete, the burner is extinguished and a retort inlet mixture comprising an oxygen supplying gas such as air, oxygen-enriched air, air diluted with off-gas and/or steam, is introduced through the conduit 24. In an exemplary embodiment air is initially introduced into the retort and after a selected time period, air diluted with steam is introduced.

The inlet mixture comprising air and steam sustains the combustion zone and advances the combustion zone and a retorting zone that is established in the fragmented mass 14 on the advancing side of the combustion zone downwardly through the fragmented mass. Kerogen in the oil shale is retorted in the retorting zone to produce liquid and gaseous products of retorting. The liquid and gaseous products flow downwardly through the fragmented mass, through the drawports 28 and into the withdrawal drift 26. The liquids flow along the drift away from the retort and into a collection sump 32 in the drift floor. The off-gas exits the drift 26 through a pipe 34 that extends through the bulkhead 30. The off-gas is sent via the pipe 34 to a processing facility for product recovery.

Referring particularly to FIG. 3, the water and liquid products of retorting, i.e., the water and shale oil collect in the sump 32 and separate into two layers; a water layer 33 and a layer 35 on top of the water layer that includes shale oil and some water in the form of a shale oil-water emulsion. The shale oil/shale oil-water emulsion 35 is withdrawn from the sump 32 by means of a pipe 36 that extends between the sump and a pump 38 on the downstream side of the bulkhead 30. When water from the water layer 33 is above the level of the pipe 36 in the sump, such water is withdrawn via the pipe 36.

Shale oil and water are pumped from the sump to a conventional separator 42 where the shale oil and water are separated from each other. The shale oil is the product sought and thus, is sent from the separator for further processing and recovery. The water is sent to a storage pond 44 (labeled cooling and storage) which serves to cool it as needed. The water from the sump is called "sour water" which can contain some emulsified oil as well as soluble materials from the oil and shale.

During the retorting operation, due to the continued introduction of the air/steam retort inlet mixture, the combustion and retorting zones travel downwardly through the fragmented mass. Such travel is rather slow, for example, about a foot or so per day. Thus, in a commercial size retort, which can be several hundred feet tall, the retorting process can take months to complete, i.e., it can take months to drive the combustion and retorting zones from the top of the retort to its bottom.

Although gas produced by combustion in the combustion zone can be at a temperature of 1400° or hotter, the off-gas from the retort during the initial stages of retorting is substantially cooler. This is because the combustion gases are cooled as they pass downwardly through the cool, unretorted portions of the fragmented mass below the combustion and retorting zones. For example, during the first several months of a typical retorting process, the retort off-gas has been found to be near the water saturation temperature of off-gas at the pressure in the withdrawal drift. For purposes of exposition herein, when such off-gas is at the water saturation temperature of off-gas at the pressure in such a drift, it is said to be at the "steam plateau temperature". Since the pressure in the withdrawal drift is preferably at less atmospheric pressure, e.g., about 10 psia, so that any gas leakage will be into the drift instead of out from it, the off-gas temperature during the first stages of retorting is commonly less than about 150° F.

As retorting continues, however, and the combustion and retorting zones approach the bottom of the fragmented mass, the off-gas temperature starts to rise above the steam plateau temperature. In the situation where the combustion zone does not pass through the retort in a uniform flat wave but is skewed, i.e., when some portions of the combustion front pass through the fragmented mass faster than other portions, the off-gas temperature can start to rise at an even earlier time than when the combustion front is flat.

Since, as mentioned above, the gas seal or bulkhead 30 can lose its gas-tight integrity if the off-gas temperature increases above the design temperature of the bulkhead, retorting may have to be stopped due to high off-gas temperature before all of the fragmented mass in the retort is processed, i.e., before the fragmented mass is completely swept by the retorting zone. This causes a reduction of product yields from the retort.

In accordance with practice of principles of the process of this invention, several techniques which are described in detail below, are provided for use either alone or in combination to maintain the off-gas temperature in the vicinity of the bulkhead 30 below the bulkhead design temperature. By applying one or more of the techniques of this invention, the time during which retorting can be safely conducted is extended, which in turn, increases product yields.

In addition to the requirement that retorting must be discontinued due to high off-gas temperatures, early shut-down of retorting can result from the concentration of oxygen in the off-gas increasing to above safe levels due to "oxygen breakthrough". As is described below in greater detail, techniques provided in accordance with this invention eliminate problems associated with such oxygen breakthrough.

The first technique provided in accordance with this invention for reducing the off-gas temperature, is to spray water into the off-gas stream at a point upstream from the gas seal 30. The direct contact of the off-gas with the cooler water and the vaporization of water lowers the temperature of the off-gas to a desired level so that the bulkhead, the drift walls downstream from the water spray, and equipment downstream from the bulkhead, for example, gas blowers and associated equipment, are protected.

In an exemplary embodiment of a spray system provided in accordance with practice of this invention for spraying water into the drift, a water spray pipe 46 extends through the bulkhead 30 and into the drift 26. In the illustrated embodiment, the spray pipe is positioned in about the center of the drift and is supported in this position by means of a support pipe 48 through which the spray pipe 46 extends. Alternatively, if desired, other support means such as pipe racks, pipe hangers and the like, can be provided to support the spray pipe 46 in its desired position.

When the off-gas temperature in the vicinity of the bulkhead 30 increases to above a selected temperature due to the continued introduction of the air/steam retort mixture, e.g., when the off-gas temperature begins rising above the steam plateau temperature, a pump 50 which is connected by suitable piping to the cooling pond 44 can be energized to pump water through the spray pipe 46. While the water being sprayed in the exemplary embodiment is water recovered from the retorting process, e.g., sour water from the sump 32, it should be understood that other water sources can be used if desired. For example, in other embodiments, cooling water from contact condensers (not shown) which are used in the off-gas recovery system can be used as the spray water. In yet another exemplary embodiment, the water used for the spray is recycled directly from the sump 32 to the spray line 46 and the water from the storage pond or contact condensers is used as a back-up supply. For example, (as is shown in FIG. 3) in this embodiment, a pipe 47 extends from the water layer 33 in the sump 32 to a pump 49 on the downstream side of the bulkhead 30. The pump 49 can be energized to recycle water from the sump directly to the spray line 46.

In any event, it is preferred that at least one supply of spray water, i.e., either the primary supply or the back-up supply, is elevated above the drift 26 so that a static head is provided on the spray pipe 46. Preferably, the height of such a water supply above the drift is sufficient that a sufficient amount of water will continue to be sprayed through the pipe 46 in the event of a spray pump failure, e.g., due to an electrical outage, to thereby maintain the off-gas temperature below the design temperature of the bulkhead 30.

The spray water exits the spray pipe 46 through a nozzle 51 on the end of the pipe remote from the bulkhead 30. Although only one such nozzle is shown, more than one nozzle can be used if desired and the nozzles can have various configurations. The water is preferably pumped at a sufficient volume and pressure and the nozzle is of such a design that a plume 52 of water is formed which extends across the entire vertical cross section of the drift. Thus, all of the off-gas passing through the drift must pass through the water plume 52 and is therefore cooled before it comes into contact with the drift walls downstream from the spray and the bulkhead 30. The major portion of the cooling of the off-gas provided by the water spray results from the heat taken up by vaporization (evaporation) of the water being sprayed into the off-gas stream in the drift. If the droplet size of the water being sprayed is too large, more water than is desired falls to the drift floor without being evaporated. Thus, when the droplets are relatively large, in order to provide a desired amount of cooling, a relatively larger volume of water must be sprayed into the drift. This increases the energy requirement of the pumps and thereby decreases the overall efficiency of the retorting process. In a preferred embodiment, the average size of the droplets produced by the spray nozzle 51 in accordance with practice of this invention, is about 250 microns. It was calculated that with droplets of this size, it is possible to obtain good evaporation of the water over the range of cooling requirements in an in situ oil shale retort so the temperature of the off-gas in the vicinity of the bulkhead can be maintained at no more than about 180° F. Maintaining the temperature of off-gas in the vicinity of the bulkhead below 180° F. provides a safety margin below the 250° F. design temperature of the bulkhead.

Although water droplets with an average size less than about 250 microns can be used, it would require relatively more energy to pump the spray water through the smaller nozzle orifices required to provide such smaller droplets than it does to pump water through the 250 micron nozzle. Since water droplets having an average size of less than 250 microns are not required to provide the desired cooling, it is preferred that such smaller droplets not be used.

It is preferred that the plume 52 extends across the entire vertical cross section of the drift 26 so that the water contacts the formation surrounding the drift to thereby cool it. Such cooling of the formation surrounding the drift inhibits sloughing of the formation which can, for example, cause damage to the spray system and other components that are located in the drift. Furthermore, sloughing of formation surrounding the drift in the vicinity of the bulkhead could cause gas leakage around the bulkhead.

Preferably the spray system is designed so that the volume of water that can be sprayed into the drift is sufficient to maintain the off-gas temperature in the vicinity of the bulkhead below its design temperature until the entire fragmented mass is processed. Since the off-gas temperatures continue to rise as the combustion front approaches the bottom of the retort and such temperatures are calculated to be 500° F. or hotter during later stages of retorting, the spray system is preferably designed to handle temperatures of this magnitude or hotter.

A flow alarm (not shown) is associated with the water being sprayed through the spray pipe 46 and is set to alarm if the flow through the pipe decreases to a pre-selected value. For example, the alarm will sound if the spray nozzle 51 should become plugged.

Although, in the illustrated embodiment a filter or strainer 53 is provided in the water line between the pumps 49 and 50 and the pipe 46 to prevent plugging, in order to provide for the contingency that the spray will become plugged, in a preferred embodiment of this invention, a back-up spray 54, is provided. In the illustrated embodiment (shown in FIG. 3) for example, the back-up spray 54 extends through the bulkhead 30 and into the drift 26 below primary spray 46. Other back-up spray arrangements can be provided if desired.

Preferably in accordance with this invention, valve and packing gland arrangements (not shown) which are known in the art, are provided so that the sprays 46 and 54 can both be removed from the drift for cleaning during the time that the retort is operating. Thus, for example, if the primary spray nozzle 51 should become plugged, water can be shut off to the pipe 46 and directed to the back-up pipe 54. Water is then sprayed through the pipe 54 in sufficient volume to provide for cooling of the off-gas to maintain the off-gas temperature in the region of the bulkhead below the bulkhead design temperature. The pipe 46 can be removed from the drift 26 by pulling it through the bulkhead 30 and associated valve and packing gland system. Once the nozzle in the pipe 46 is cleaned, the pipe is reinstalled in the drift by reversing the removal process. Water is then redirected to the primary pipe 46 and discontinued to the back-up pipe 54.

A second technique provided for use in accordance with practice of this invention either as an alternative to the use of water sprays or preferably in addition to such use, is to reduce or discontinue the introduction of steam in the retort inlet mixture. The reduced steam flow can prolong the retorting process and therefore can increase sweep efficiency. The total energy content of the off-gas can also be reduced by this technique.

Thus, for example, in one exemplary embodiment of practice of this invention, during a first time period a retort inlet mixture is provided that comprises both steam and an oxygen supplying gas such as air, e.g., a mixture comprising 80% by volume air and 20% by volume steam. After the off-gas temperature begins to rise above the "steam plateau temperature" either the pump 49 or 50 is started to spray water into the drift to thereby maintain the off-gas temperature in the vicinity of the bulkhead 30 below a selected value. Thereafter, during a second time period, which starts after the water spraying operation has commenced, steam is discontinued being introduced into the retort inlet or the amount of steam is reduced for prolonging the retorting process and for reducing the total energy content of the off-gas. Discontinuing steam (or reducing the amount) reduces the total energy content of the off-gas, firstly because in the absence (or reduction) of steam, less energy is being introduced into the retort via the retort inlet mixture and secondly the quantity of off-gas that must be cooled is reduced. Therefore, discontinuing introduction of steam (or reducing the amount) aids the spray system in maintaining the off-gas temperature in the vicinity of the bulkhead below the bulkhead design temperature.

A third technique provided for use in accordance with practice of this invention either as an alternative to the first and second techniques described above or preferably in addition thereto, is to reduce the amount of the oxygen supplying gas (air) in the retort inlet mixture during the later stages of retorting. Reduced air flow tends to prolong the retorting process, increase sweep efficiency, and reduce the heat load on the retort and thus, the total energy content of the off-gas. Reducing the amount of air introduced into the retort reduces the total energy content of the off-gas because with a reduction of air the total quantity of the off-gas is reduced. Therefore, reducing inlet air flow aids the spray system in maintaining the off-gas temperature in the vicinity of the bulkhead below the bulkhead design temperature. Reduced air flow also decreases the potential oxygen content of the off-gas. Thus, reducing air flow could prolong retorting in the event that oxygen breakthrough occurs.

Both the second and third techniques provided in accordance with this invention for reducing the total energy content of the off-gas are particularly useful when either the off-gas temperature is hotter than expected or when the spray system is malfunctioning or does not have a sufficient capacity to maintain the temperature of the off-gas below the design temperature of the bulkhead.

A fourth technique provided in accordance with practice of this invention results in both a reduced heat load on the retort and ensures that oxygen breakthrough does not occur during later stages of retorting. This fourth technique includes discontinuing introduction of oxygen into the retort by introducing a retort inlet mixture comprising off-gas which has been recycled from the retort and is substantially free of oxygen. If desired, the off-gas can be recycled from another retort being processed at the same time.

It can be desirable to discontinue introduction of air and start recycle off-gas in response to any of several events. For example, calculations can be made to determine the amount of heat required to complete processing remaining unretorted portions of the fragmented mass 14 at any given time during the later stages of retorting. Additionally, the amount of heat contained in the retort at any given time can be calculated. When the amount of heat in the retort is sufficient to complete retorting, i.e., when the amount of heat is sufficient to sustain the retorting zone as it is driven downwardly through the bottom portion of the fragmented mass, air, i.e., the oxygen supplying gas in the inlet mixture, can be discontinued and recycle gas injection started.

Since there is substantially no oxygen in recycle off-gas, the combustion zone is extinguished while the retorting zone continues its advancement through the retort in the absence of the combustion zone. For example, in an exemplary embodiment of the process of this invention, after the combustion and retorting zones have advanced downwardly through a major upper portion of the fragmented mass due to the continued introduction of a retort inlet mixture comprising oxygen, it is determined that the heat contained in the retort is sufficient to complete retorting the remaining minor lower portion of the fragmented mass. In accordance with practice of principles of this invention the "major upper portion of the fragmented mass" is at least about the upper 80% of the fragmented mass. At this time, a retort inlet mixture comprising recycle off-gas, is introduced into the top of the retort. Introduction of recycle gas into the top of the retort as the retort inlet mixture, provides for continued advancement of the retorting zone, in the absence of a combustion zone, downwardly through the minor lower portion of the fragmented mass to the retort's bottom. This technique, which eliminates the combustion zone and resulting generation of heat during the later stages of retorting, enables the bottom portions of the fragmented mass to be retorted without the off-gas temperature increasing to a level that may require discontinuing retorting. Furthermore, using recycle off-gas as the retort inlet mixture instead of an oxygen supplying gas eliminates any potential problem of "oxygen breakthrough" and thus, ensures that the oxygen concentration in the off-gas will not increase to unsafe levels once such recycle gas injection has started.

As an alternative to starting recycle off-gas injection based on the amount of heat contained in the retort and the amount of remaining unretorted fragmented mass at the retort's bottom, it may be desired to start recycle off-gas injection based on the concentration of oxygen in the off-gas.

For example, once the combustion zone is established across the surface **14*a*** of the fragmented mass during ignition, all of the oxygen in the retort inlet mixture is consumed in the combustion zone. Thus, during the retorting operation, the off-gas contains virtually no oxygen. During the later stages of retorting, if any oxygen is detected in the off-gas due to "oxygen breakthrough", even if the concentration is below the "maximum acceptable concentration", it may be desired to stop the flow of oxygen supplying gas into the retort and start recycle off-gas injection. This is because when any oxygen is in the off-gas, combustion can occur in the withdrawal drift. Such combustion can increase the heat load on the system and can tend to increase the off-gas temperature to above the bulkhead design temperature Furthermore, such combustion can consume valuable hydrocarbons in the off-gas.

After the recycle off-gas injection has driven the retorting zone through the remaining fragmented mass at the bottom of the retort, e.g., as evidenced by a reduction in product recovery rates, retorting can be discontinued. To discontinue retorting, the recycle off-gas injection is discontinued and water is injected into the top of the retort as a quench. It should be noted that some liquid and gaseous products can be produced even during the water quenching operation. After a selected time the off-gas recovery system is de-energized and water being sprayed into the drift 26 via the spray pipe 46 is discontinued.

EXAMPLE

In two working embodiments of practice of principles of the process of this invention, two virtually identical in situ oil shale retorts similar to the retort 10 shown in FIGS. 1-3 were processed. The working embodiment of the process of this example is therefore described in terms of the illustrated retort. Since the processing steps used for processing both such retorts were similar, the processing of only one of the retorts is described below.

The retort 10 was square in horizontal cross section having sides of about 165 feet in length and was about 241 feet tall. A fragmented permeable mass of formation particles 14 was contained within the top, side, and bottom boundaries 16, 18, and 20 respectively, of unfragmented formation. A void space 22 about 14.6 feet high was between the surface 14*a* of the fragmented mass and the top boundary 16 of the retort.

To start the retorting process, hot inert products of combustion of a mixture of shale oil and air were directed from a burner into the retort from a drift (not shown) extending horizontally through one of the side boundaries into the void space 22. After the top surface region of the fragmented mass was ignited, the burner was shut off and a retort inlet mixture comprising air was introduced into the retort through a plurality of inlets such as the inlet 24. A combustion zone was formed in the fragmented mass and was advanced downwardly through the retort due to the continued introduction of the retort inlet mixture. Liquid and gaseous products were produced in a retorting zone formed on the advancing side of the combustion zone.

The liquid products and an off-gas comprising gaseous products exited the retort through five drawports 28 and passed into the withdrawal drift 26. The off-gas including gaseous products of retorting exited the drift 26 through the off-gas pipe 34. Liquid products and water, i.e., the layer 35 comprising shale oil and the shale oil-water emulsion that collected in the sump 32 were removed for further processing via the line 36.

During the retorting process the pressure in the product withdrawal drift was maintained at less than atmospheric pressure. Nominally the pressure was maintained at about 10 psia.

About one month after ignition was complete, steam was introduced along with air into the retort inlet mixture. The ratio of steam to air was about 20 percent steam to about 80 percent air based on the total volume of the retort inlet mixture.

The temperature of the off-gas in the drift 26 in the vicinity of the bulkhead 28 was monitored. For about the first six to seven months of retorting, i.e., during the six to seven months after ignition was completed, the temperature in the off-gas remained between about 140° F. and 150° F. which was the saturation temperature of off-gas for the pressure in the drift, i.e., the steam plateau temperature.

The design temperature of the bulkhead 30 in this working embodiment was considered to be 250° F. Thus, it was desired that the off-gas temperature in the vicinity of the bulkhead be maintained below 250° F. so that retorting could be continued.

About seven months or so after retorting started, the off-gas temperature began to increase above the steam plateau temperature. After an additional three weeks or so, the retort off-gas temperature had increased to about 180° F. When the temperature reached 180° F., water, from the sump 32, was sprayed via the line 47 and pump 49 through the spray line 46 and nozzle 51 into the drift 26. At times additional water was also supplied via the pump 50 to make up for water loss due to evaporation. The temperature of the spray water was between about 140° F. and 170° F. and the average size of the water droplets was about 250 microns or so. Initially, about 8 gallons per minute (gpm) were sprayed through the line 46. As the off-gas temperature from the retort continued to rise, the spray rate was increased as appropriate to maintain the off-gas temperature downstream from the spray in the vicinity of the bulkhead 30 at about 180° F. The spray rate, for example, was increased to about 19 gpm, approximately eight-and one-half months after retorting commenced, to about 27 gpm about nine months and one week after retorting commenced, and was increased to about 32 gpm about nine months and three weeks after retorting commenced. During this time, the measured retort off-gas temperature in the vicinity of the bulkhead was maintained at less than 180° F. When the capacity of the spray system was reached, which occurred about ten months after retorting commenced, steam was discontinued in the retort inlet mixture to reduce the heat load on the retort. This resulted in the off-gas temperature in the vicinity of the bulkhead 30 remaining below 180° F. About two weeks later, air flow to the retort was discontinued and recycle off-gas was introduced into the retort as the retort inlet mixture.

Introduction of the recycle off-gas extinguished the combustion zone and eliminated any possibility that oxygen would be present in the off-gas.

After an additional three weeks or so, recycle gas injection was discontinued and water was introduced into the top of the retort as a quench. The quench was started about eleven and one-half months after retorting had commenced. About two months later the gas recovery system blowers were turned off and a week or so later water was discontinued to the spray 46.

It was calculated that if no water sprays had been used, the off-gas temperature in the vicinity of the bulkhead would have been about 280° F. about eight and one-half months after retorting started, and would have been about 360° F. two weeks later. About eleven-and one-half months after retorting started, the off-gas temperature would have been over 500° F. Thus, using the water sprays and other techniques provided in accordance with this invention increased the time that retorting could be safely conducted, by about two-and one-half to three months. Product yields from the retort were increased accordingly. For example, the total yield from the retort was about 107,000 barrels of shale oil and it is estimated that at least about the last 30% or 32,000 barrels of oil were recovered as a direct result of practice of the above described techniques of this invention for prolonging retorting.

The above description of a method for reducing the temperature of the off-gas in the vicinity of the gas-sealing bulkhead in the retort withdrawal drift is for illustrative purposes. Because of variations which will be apparent to those skilled in the art, the present invention is not intended to be limited to the particular embodiments described above. For example, if desired, two or more sprays can be used as primary sprays instead of one. Additionally, when a single primary spray is used, it may not be necessary to position it in the center of the drift. The scope of the invention is defined in the following claims.

What is claimed is:

1. A method for operating an in situ oil shale retort in a subterranean formation containing oil shale, the retort containing a fragmented permeable mass of formation particles containing oil shale within top, bottom and side boundaries of unfragmented formation and havig a drift in communication with a lower region of the fragmented mass for withdrawal of liquid products of retorting and an off-gas comprising gaseous products of retorting, the method comprising the steps of:

introducing a retort inlet mixture into an upper region of the fragmented mass in the retort for advancing a retorting zone downwardly through the retort for producing liquid and gaseous products of retorting;

withdrawing retort off-gas comprising gaseous products of retorting through the product withdrawal drift;

monitoring the temperature of the off-gas in the product withdrawal drift; and when the temperature of the off-gas exceeds a first selected temperature, spraying a sufficient amount of water into the off-gas stream in the withdrawal drift for contacting formation surrounding the drift with cooling water and for maintaining the temperature of the off-gas at no more than a second selected temperature.

2. A method for operating an in situ oil shale retort in a subterranean formation containing oil shale, the retort containing a fragmented permeable mass of formation particles containing oil shale within top, bottom and side boundaries of unfragmented formation and having a drift in communication with a lower region of the fragmented mass for withdrawal of liquid products of retorting and an off-gas comprising gaseous products of retorting, the method comprising the steps of:

introducing a retort inlet mixture into an upper region of the fragmented mass in the retort for advancing a retorting zone downwardly through the retort for producing liquid and gaseous products of retorting;

withdrawing retort off-gas comprising gaseous products of retorting through the product withdrawal drift;

monitoring the temperature of the off-gas in the product withdrawal drift; and when the temperature of the off-gas exceeds a first selected temperature, spraying a sufficient amount of water into the off-gas stream in the withdrawal drift for maintaining the temperature of the off-gas at no more than a second selected temperature, wherein the water is sprayed in a pattern that extends across the entire vertical cross section of the drift.

3. The method according to claim 2 wherein the first selected temperature is no more than about 180° F.

4. The method according to claim 2 wherein the second selected temperature is less than about 250° F.

5. The method according to claim 2 wherein the average particle size of the droplets sprayed into the off-gas stream is no more than about 250 microns.

6. A method for operating an in situ oil shale retort in a subterranean formation containing oil shale, the retort containing a fragmented permeable mass of formation particles containing oil shale within top, bottom and side boundaries of unfragmented formation and having a drift in communication with a lower region of the fragmented mass for withdrawal of liquid products of retorting and an off-gas comprising gaseous products of retorting, the method comprising the steps of:

introducing a retort inlet mixture into an upper region of the fragmented mass in the retort for advancing a retorting zone downwardly through the retort for producing liquid and gaseous products of retorting;

withdrawing retort off-gas comprising gaseous products of retorting through the product withdrawal drift;

monitoring the temperature of the off-gas in the product withdrawl drift; and when the temperature of the off-gas exceeds a first selected temperature, spraying a sufficient amount of water into the off-gas stream in the withdrawl drift for maintaining the temperature of the off-gas at no more than a second selected temperature; and wherein during a fist time period a retort inlet mixture comprising air and steam is introduced into the retort, and during a second time period, late than the first time period, a retort inlet mixture comprising air in the substantial absence of steam is introduced into the retort, wherein the second time period commences after the water spraying operation is started.

7. The method according to claim 5 wherein the second selected temperature is no more than about 180° F.

8. A method for operating an in situ oil shale retort in a subterranean formation containing oil shale, the retort containing a fragmented permeable mass of formation particles containing oil shale within top, bottom and side boundaries of unfragmented formation, the method comprising the steps of:

igniting an upper region of the fragmented mass for establishing a combustion zone therein;

introducing a retort inlet mixture comprising an oxygen supplying gas and steam into the top of the fragmented mass for advancing the combustion zone downwardly through the fragmented mass to thereby establish a retorting zone in the fragmented mass on the advancing side of the combustion zone for producing liquid and gaseous products of retorting;

withdrawing an off-gas comprising gaseous products of retorting from the bottom of the fragmented mass;

monitoring the temperature of the off-gas, and when the off-gas temperature reaches a selected value:

spraying sufficient water into the off-gas for maintaining the off-gas temperature below a selected maximum temperature; and after spraying has started introducing a retort inlet mixture comprising recyle off-gas substantially free of oxygen into the top of the fragmented mass for advancing the retorting zone downwardly through the fragmented mass.

9. The method according to claim 8 wherein the selected maximum temperature is less than about 250° F.

10. A method for operating an in situ oil shale retort in a subterranean formation containing oil shale, the retort containing a fragmented permeable mass of formation particles containing oil shale within top, bottom, and side boundaries of unfragmented formation, the method comprising the steps of:

igniting an upper region of the fragmented mass for establishing a combustion zone therein;

introducing a retort inlet mixture comprising an oxygen supplying gas and steam into the top of the fragmented mass for advancing the combustion zone downwardly through the fragmented mass to thereby establish a retorting zone in the fragmented mass on the advancing side of the combustion zone for producing liquid and gaseous products of retorting;

withdrawing an off-gas comprising gaseous products of retorting from the bottom of the fragmented mass;

monitoring the temperature of the off-gas, and when the off-gas temperature reaches a selected value:

spraying sufficient water into the off-gas for maintaining the off-gas temperature below a selected maximum temperature; and after spraying has started discontinuing introduction of steam in the retort inlet mixture while continuing to introduce the oxygen supplying gas; and thereafter introducing a retort inlet mixture comprising recycle off-gas substantially free of oxygen into the top of the fragmented mass to thereby extinguish the combustion zone while continuing to advance the retorting zone downwardly through the fragmented mass.

11. The method according to claim 10 wherein spraying is started when the off-gas temperature increases above the steam plateau temperature.

12. The method according to claim 10 wherein the selected maximum temperature is less than about 250° F.

13. The method according to claim 10 wherein the average particle size of the droplets sprayed into the off-gas stream is about 250 microns.

14. A method for operating an in situ oil shale retort in a subterranean formation containing oil shale, the retort containing a fragmented permeable mass of formation particles containing oil shale within top, bottom and side boundaries of unfragmented formation, the method comprising the steps of:

introducing a first retort inlet mixture comprising oxygen into an upper region of the fragmented permeable mass and withdrawing an off-gas from a lower region of the fragmented permeable mass for advancing a combustion zone downwardly through a major upper portion of the fragmented mass and for advancing a retorting zone downwardly through the fragmented mass on the advancing side of the combustion zone; and thereafter introducing a second retort inlet mixture substantially free of oxygen into the upper region of the fragmented permeable mass and withdrawing an off-gas from the lower region of the fragmented permeable mass for advancing a retorting zone in the absence of a combustion zone downwardly through a minor lower portion of the fragmented mass.

15. The method according to claim 14 wherein the major upper portion of the fragmented mass comprises at least about the upper 80% of the fragmented mass.

16. The method according to claim 14 wherein during at least a portion of the period of time the second retort mixture is being introduced, water is sprayed into the off-gas stream for maintaining the temperature of the off-gas stream below a selected temperature.

17. The method according to claim 14 wherein the first retort inlet mixture additionally comprises steam and the second retort inlet mixture comprises recycle off-gas.

18. The method according to claim 17 wherein the first retort inlet mixture additionally comprises steam and the second retort inlet mixture comprises recycle off-gas.

19. A method for operating an in situ oil shale retort in a subterranean formation containing oil shale, the retort containing a fragmented permeable mass of formation particles containing oil shale within top, bottom and side boundaries of unfragmented formation and having a drift in communication with a lower region of the fragmented mass for withdrawal of liquid products of retorting and off-gas comprising gaseous products of retorting, the method comprising the steps of:

igniting an upper region of the fragmented mass for establishing a combustion zone therein;

introducing a first retort inlet mixture comprising air at a first flow rate and steam into the top of the fragmented mass for advancing the combustion zone downwardly through the fragmented mass to thereby establish a retorting zone in the fragmented mass on the advancing side of the combustion zone for producing liquid and gaseous products of retorting;

withdrawing such liquid products and an off-gas comprising such gaseous products through the withdrawal drift;

monitoring the temperature of the off-gas in the withdrawal drift and when the off-gas temperature reaches a selected value:

spraying a sufficient amount of water into the off-gas stream in the withdrawal drift for maintaining the off-gas temperature downstream from the spray below a selected maximum; thereafter discontinuing introduction of steam in the first retort inlet mixture; thereafter reducing the flow rate of air in the first retort inlet mixture to a second flow rate less than the first flow rate; and thereafter discontinuing introduction of air into the top of the fragmented mass and introducing a second retort inlet mixture consisting essentially of recycle off-gas into the top of the fragmented mass.

20. The method according to claim 19 comprising spraying a sufficient amount of water into the off-gas stream in the withdrawal drift for maintaining the off-gas temperature downstream from the spray below about 250° F.

21. The method according to claim 19 wherein the average particle size of the water droplets sprayed into the off-gas stream in the withdrawal drift is no more than about 250 microns.

22. The method according to claim 19 wherein the water is sprayed into the off-gas stream in a pattern that extends across the entire vertical cross section of the withdrawal drift.

23. A method for operating an in situ oil shale retort in a subterranean formation containing oil shale, the retort containing a fragmented permeable mass of formation particles containing oil shale within top, bottom, and side boundaries of unfragmented formation and having a drift in communication with a lower region of the fragmented mass for withdrawal of liquid products of retorting and an off-gas comprising gaseous products of retorting, the method comprising the steps of:

placing a gas-sealing bulkhead across the product withdrawal drift;

installing a water spray pipe in the product withdrawal drift;

igniting an upper region of the fragmented mass for establishing a combustion zone therein;

introducing a retort inlet mixture comprising an oxygen supplying gas into the top of the fragmented mass for advancing the combustion zone downwardly through the fragmented mass to thereby establish a retorting zone in the fragmented mass on the advancing side of the combustion zone for producing liquid and gaseous products of retorting;

withdrawing a retort off-gas comprising gaseous products of retorting from the retort through the product withdrawal drift; and monitoring the temperature of the off-gas in the vicinity of the gas sealing bulkhead, and when the off-gas temperature reaches a selected value below the design temperature of the bulkhead, spraying sufficient water into the off-gas upstream from the gas sealing bulkhead for maintaining the temperature of the off-gas in the vicinity of the bulkhead below said design temperature.

24. The method according to claim 23 wherein sufficient water is sprayed into the off-gas stream for maintaining the temperature of the off-gas in the vicinity of the bulkhead below about 180° F.

25. The method according to claim 23 wherein the average particle size of the droplets sprayed into the off-gas stream is about 250 microns.

26. The method according to claim 23 wherein the water spraying is started when the off-gas temperature in the vicinity of the bulkhead reaches no more than about 180° F.

27. The method according to claim 23 additionally comprising installing a second water spray pipe in the product withdrawal drift through the gas-sealing bulkhead, wherein the first-mentioned water spray pipe is used as a primary spray, and the second water spray pipe is used as a backup spray in case said primary spray malfunctions.

28. The method according to claim 23 wherein the water spray pipe is installed in a support pipe which extends through the gas-sealing bulkhead, the support pipe supporting the end of the spray nozzle on the end of the spray pipe near the center of the withdrawal drift.

29. The method according to claim 23 additionally comprising the steps of:

removing shale oil and water from the withdrawal drift;

separating the shale oil from the water; and recirculating the separated water to the water spray pipe for the spraying operation.

30. The method according to claim 23 wherein the water is sprayed in a pattern that extends across the entire vertical cross section of the drift.

31. The method according to claim 23 wherein the water spray pipe extends into the withdrawal drift through the gas sealing bulkhead.

32. The method according to claim 31 wherein the water spray pipe can be removed from the withdrawal drift during retorting operations without impairing the gas sealing integrity of the bulkhead.

33. A method for operating an in situ oil shale retort in a subterranean formation containing oil shale, the retort containing a fragmented permeable mass of formation particles containing oil shale within top, bottom, and side boundaries of unfragmented formation and having a drift in communication with a lower region of the fragmented mass for withdrawal of liquid products of retorting and an off-gas comprising gaseous products of retorting, the method comprising the steps of:

placing a gas sealing bulkhead across the product withdrawal drift;

installing a water spray pipe in the product withdrawal drift;

igniting an upper region of the fragmented mass for establishing a combustion zone therein;

during a first time period, introducing a retort inlet mixture comprising an oxygen supplying gas and steam into the top of the fragmented mass for advancing the combustion zone downwardly through the fragmented mass to thereby establish a retorting zone in the fragmented mass on the advancing side of the combustion zone for producing liquid and gaseous products of retorting;

withdrawing a retort off-gas comprising gaseous products of retorting from the retort through the product withdrawal drift;

monitoring the temperature of the off-gas in the vicinity of the gas sealing bulkhead, and when the off-gas temperature reaches a selected value below the design temperature of the bulkhead, spraying sufficient water into the off-gas stream for maintaining the temperature of the off-gas in the vicinity of the bulkhead below said design temperature;

during a second time period, which commences after the water-spraying operation has started, discontinuing introduction of steam in the retort inlet mixture; and during a third time period, discontinuing introduction of the oxygen supplying gas in the retort inlet mixture and introducing a retort inlet mixture comprising recycle off-gas to thereby extinguish the combustion zone while continuing to advance the retorting zone downwardly through the fragmented mass.

34. The method according to claim 33 wherein sufficient water is sprayed into the off-gas stream for maintaining the temperature of the off-gas in the vicinity of the bulkhead below about 180° F.

35. The method according to claim 33 wherein the average particle size of the droplets sprayed into the off-gas stream is no more than about 250 microns.

36. The method according to claim 33 wherein the water-spraying operation is started when the off-gas temperature in the vicinity of the bulkhead reaches no more than about 180° F.

37. The method according to claim 33 additionally comprising installing a second water spray pipe in the product withdrawal drift through the gas-sealing bulkhead, wherein the first-mentioned water spray pipe is used as a primary spray, and the second water spray pipe is used as a back-up spray in case said primary spray malfunctions.

38. The method according to claim 33 wherein the water spray pipe is installed in a support pipe which extends through the gas sealing bulkhead, the support pipe supporting the end of the spray nozzle on the end of the spray pipe near the center of the withdrawal drift.

39. The method according to claim 33 additionally comprising the steps of:

removing shale oil and water from the withdrawal drift;

separating the shale oil from the water; and recirculating the separated water to the water spray pipe for the spraying operation.

40. The method according to claim 33 wherein the water is sprayed in a pattern that extends across the entire vertical cross section of the drift.

41. The method according to claim 33 wherein the water spray pipe extends into the withdrawal drift through the gas sealing bulkhead.

42. The method according to claim 41 wherein the water spray pipe can be removed from the withdrawal drift during retorting operations without impairing the gas sealing integrity of the bulkhead.

* * * * *